US009282409B2

(12) United States Patent
Lee

(10) Patent No.: US 9,282,409 B2
(45) Date of Patent: Mar. 8, 2016

(54) BASS SHAKER TRANSDUCER

(71) Applicant: AUDIO DESIGN EXPERTS, INC., Fountain Valley, CA (US)

(72) Inventor: Dai Zo Lee, Anaheim, CA (US)

(73) Assignee: AUDIO DESIGN EXPERTS, INC., Fountain Valley, CA (US)

( * ) Notice: Subject to any disclaimer, the term of this patent is extended or adjusted under 35 U.S.C. 154(b) by 29 days.

(21) Appl. No.: 14/248,634

(22) Filed: Apr. 9, 2014

(65) Prior Publication Data

US 2015/0296280 A1 Oct. 15, 2015

(51) Int. Cl.
*H04R 25/00* (2006.01)
*H04R 9/02* (2006.01)
*H04R 1/00* (2006.01)

(52) U.S. Cl.
CPC ..... *H04R 9/022* (2013.01); *H04R 1/00* (2013.01); *H04R 9/025* (2013.01)

(58) Field of Classification Search
CPC ..... H04R 9/066; H04R 11/02; H04R 31/006; H04R 5/023; H04R 9/025; H04R 9/043; H04R 9/045; A47C 21/006; A47C 3/02; B06B 1/045; H02K 33/16; H02K 33/18; H02K 41/0356; H02K 9/22
USPC ..... 381/412, 403, 396, 404, 419–420; 601/46; 310/15
See application file for complete search history.

(56) References Cited

U.S. PATENT DOCUMENTS

| | | | | |
|---|---|---|---|---|
| 5,424,592 | A * | 6/1995 | Bluen et al. | 310/28 |
| 7,402,922 | B2 * | 7/2008 | Springer et al. | 310/15 |
| 2004/0013283 | A1 * | 1/2004 | Coffin | 381/418 |
| 2012/0170795 | A1 * | 7/2012 | Sancisi et al. | 381/413 |
| 2012/0184883 | A1 * | 7/2012 | Song et al. | 601/46 |

* cited by examiner

*Primary Examiner* — Davetta W Goins
*Assistant Examiner* — Phylesha Dabney
(74) *Attorney, Agent, or Firm* — Plager Schack LLP; Vito Canuso, III

(57) ABSTRACT

A bass shaker system is provided that includes a motor and a motor housing, where the motor includes a motor case having first and second members shaped to tightly envelop an exterior surface of the voice coil while still leaving a gap between adjacent ends of the first and second members, and a plurality of spiders having at least four spider legs secured within a ring that has an interior shoulder to mate with a radial ridge on each of the first and second motor case members. In some embodiments, the bass shaker system includes ventilated caps and vented housing covers.

1 Claim, 4 Drawing Sheets

BASS SHAKER TRANSDUCER

BACKGROUND

The present invention relates to tactile transducers used to produce ambient vibrations in concert with audio loudspeakers and enhance the bass sound experienced. Scientifically, a tactile transducer or "bass shaker" is a device designed to allow people in the surrounding ambient to feel as well as hear low bass frequencies by transmitting low-frequency vibrations into various surfaces. Tactile transducers may augment or in some cases substitute for a subwoofer. Typically, a bass shaker is meant to be firmly attached to some surface such as a seat, couch or floor. The shaker houses a small weight that is driven by a voice coil similar to those found in dynamic loudspeakers. The voice coil is driven by a low-frequency audio signal from an amplifier; common shakers typically handle 25 to 50 watts of amplifier power. The voice coil exerts force on both the weight and the body of the shaker, with the latter forces being transmitted into the mounting surface. Tactile transducers may be used in a home theater, a commercial movie theater, or for special effects in an arcade game, amusement park ride or other application.

An early bass shaker is described in U.S. Pat. No. 5,424,592 to Bluen et al. In that patent, the named inventors described an improved electromagnetic actuator that included a first assembly, a second assembly disposed for relative movement with respect to the first assembly and at least a first flexure interconnecting the first assembly and the second assembly. The first assembly included a core having a first magnetic pole of a first polarity and a second magnetic pole of a second polarity. The second assembly included an electrical current conductive coil having a first coil portion and a second coil portion. The first magnetic pole is in a facing relationship to the first coil portion and the second magnetic pole is in a facing relationship to the second coil portion. The first coil portion and the second coil portion are arranged so that an electrical current in the coil develops additive flux current cross products at each of the first coil portion and the second coil portion. One of the first assembly and the second assembly includes a magnetic flux return path between the first coil portion and the second coil portion.

Other tactile transducers of similar and different technologies have been disclosed over the years. With time, however, certain limitations became apparent with prior art bass shakers that prevented as robust and high quality sound and vibrational output as could otherwise be achieved. The present invention addresses at least some of those limitations.

SUMMARY

Embodiments of an improved bass shaker are provided, where in one embodiment, a tactile transducer system suitable for use as a bass shaker comprises a motor that itself comprises a magnet having a generally cylindrical configuration, the magnet comprising first and second generally planar surfaces at opposite ends; first and second cover plates securable to the first and second magnet surfaces, respectively, when the motor is assembled so as to effectively sandwich the magnet between the cover plates; a voice coil comprising a multi-layer composite of two protective layers sandwiching a plurality of copper coils; a motor case comprising first and second arcuate members, the first and second arcuate members configured to tightly envelop an exterior surface of the voice coil while still leaving a gap between adjacent ends of the first and second arcuate members, the multi-piece motor case functioning together in a manner that reduces eddy currents and heat generation as compared to a unitary motor case; first and second spiders each comprising a spring portion and a ring portion, the spring portions each comprising at least four legs extending radially outward from a central hub, the spring portions comprising glass epoxy material and configured to fit snugly within the corresponding ring portion; first and second ventilated mechanical caps, each configured to secure each cover plate to a corresponding magnet surface, the ventilated mechanical fasteners comprising a plurality of apertures permitting heat and air flow therethrough during operation of the system, each ring comprising an annular shoulder configured to permit snug engagement with corresponding ridges on the motor case members to assist in keeping the motor case members aligned and secured in annular fashion with the voice coil when assembled; where the first and second spiders are configured to be mechanically fastened to the first and second ventilated mechanical fasteners, respectively to secure the motor and spiders together when the system is assembled, the motor and spider configured such that reciprocal axial movement of the magnet within the voice coil and motor case members causes the spring portions of each spider to move in concert with the magnet while the voice coil and motor case remain substantially still, and a housing comprising a base portion and a cover portion, the base portion comprising a generally annular seat to accommodate in secure attachment the motor when the system is assembled to stabilize the motor during operation, the cover portion comprising a plurality of ventilation holes to further release heat to the ambient during operation.

BRIEF DESCRIPTION OF THE FIGURES

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF CERTAIN EMBODIMENTS

Figure 1:
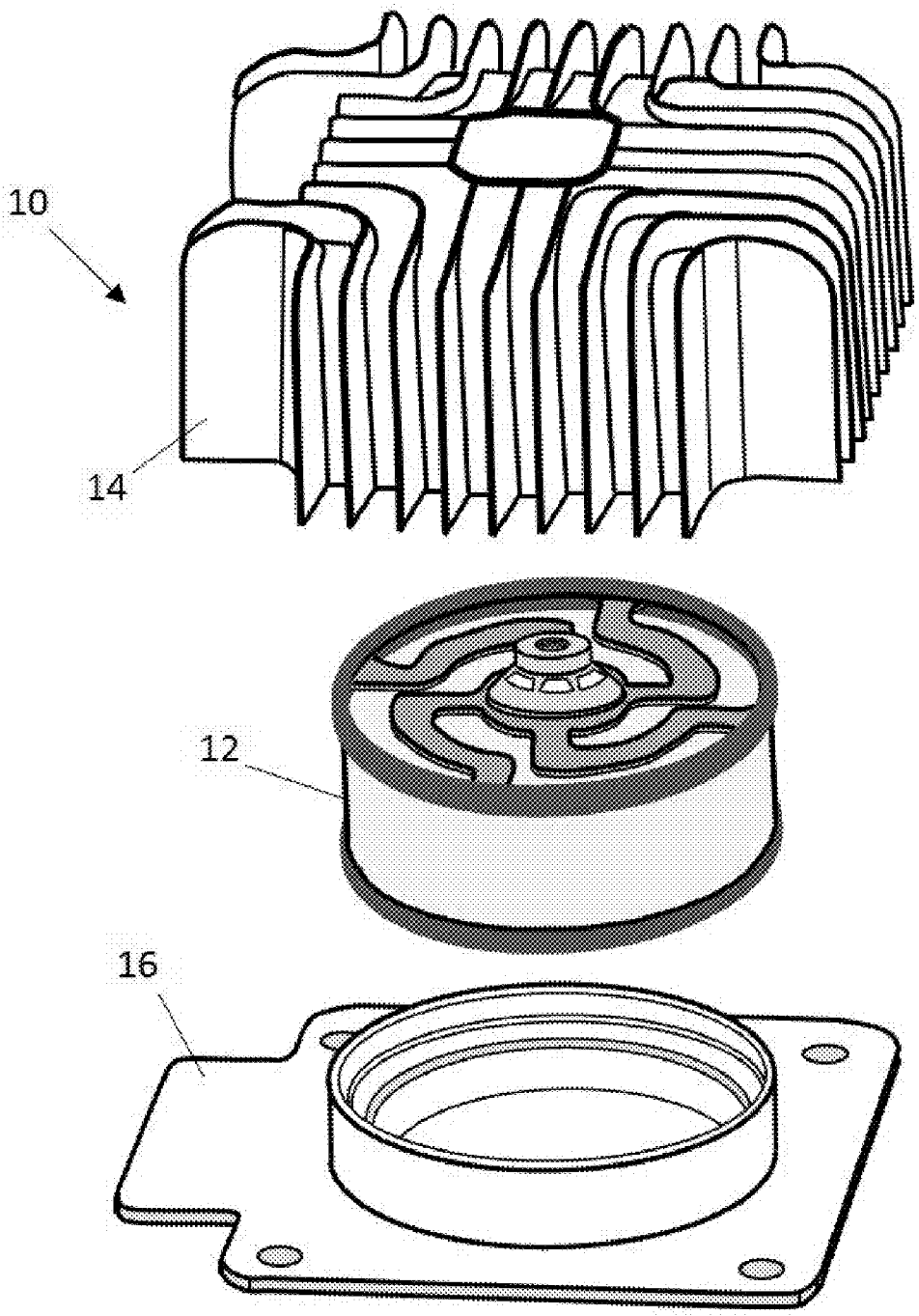
FIG. 1 shows a perspective exploded view of one embodiment of the present invention.
Figure 2:
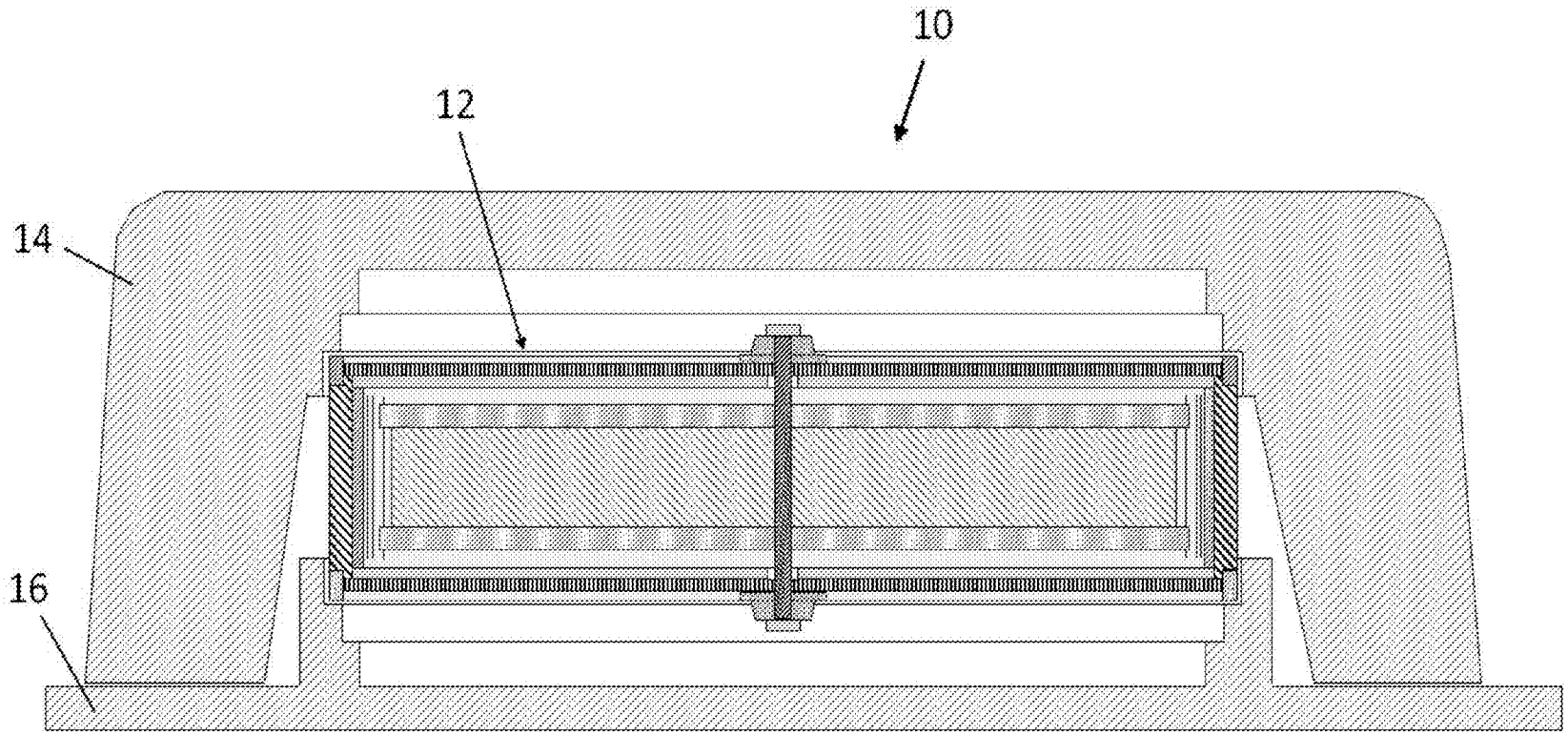
FIG. 2 shows a cross-sectional elevational view of the embodiment of FIG. 1.

By way of example, and referring to FIG. 1, one embodiment of the present system comprises a bass shaker system 10 comprising a motor 12, a cover 14 and a base 16. The motor 12 comprises a number of components described in more detail below, but in essence provides the vibrational forces that are radiated outwardly for enhancement of lower frequency sound. Preferably, the cover 14 is configured to radiate heat outwardly as quickly as possible, so the inclusion of radiation fins is desirable. The particular configuration of the cover 14 is not critical to the present invention; thus, numerous possible configurations are contemplated for the effective enclose of the motor 12 with optimized heat transfer to the ambient. The base 16 is preferably generally flat so that it may be secured to a surface to which a user desires to transfer vibrational forces, as a table, seat or floor. Preferably, the base includes a support collar to support the motor 12 in a stable position while still permitting vibrational oscillation of certain components of the motor 12, as described below. In that regard, with reference to FIG. 2, it can be appreciated that the motor 12 preferably rests securely within the collar of the base 16 and within a corresponding collar within the interior of the cover 14. As with the cover 14, the configuration of the base 16 is not critical, so may be one of numerous possible shapes and sizes to effectively engage the cover to enclose the motor stably.

Figure 3:
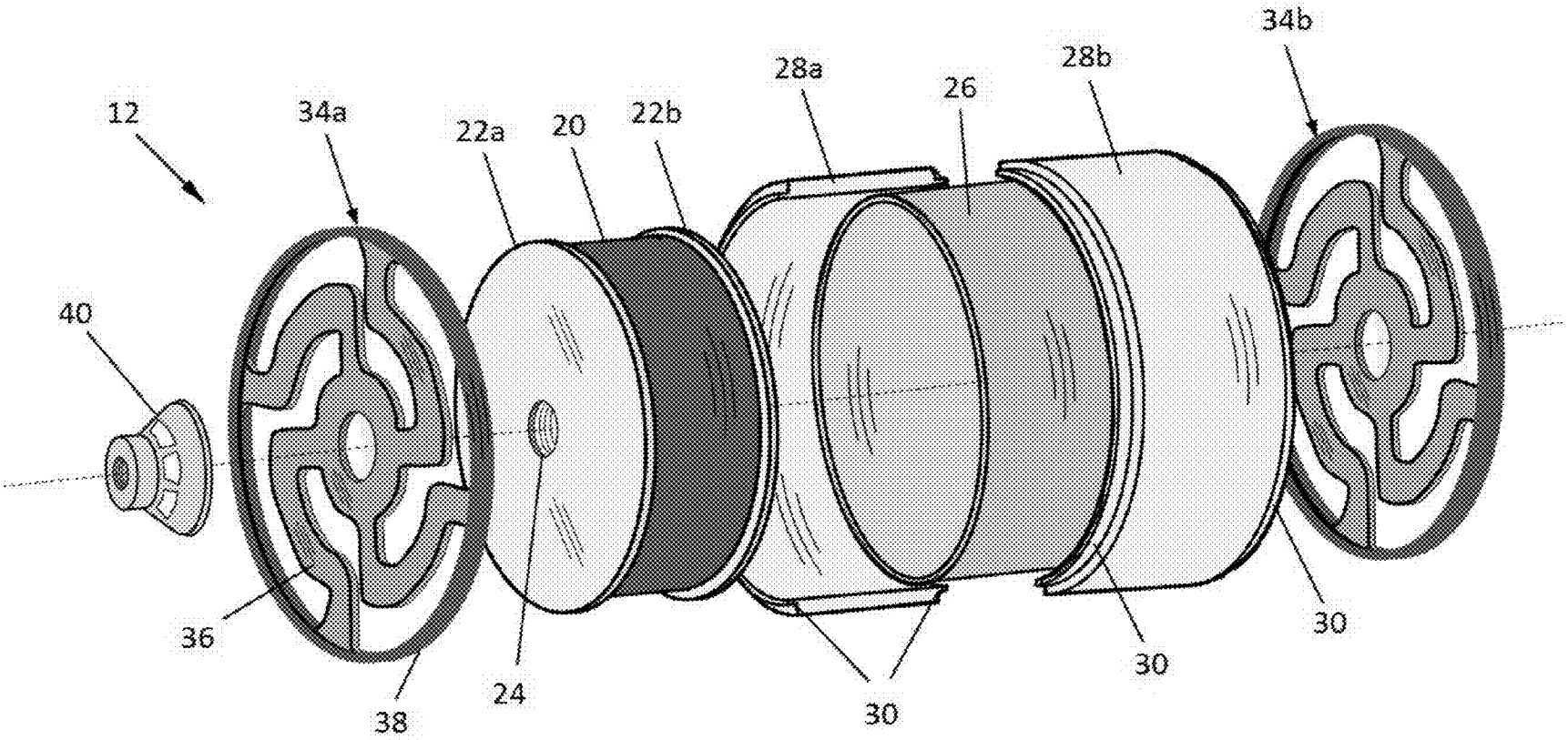
FIG. 3 shows a perspective exploded view of the embodiment of FIG. 1.
Figure 4:
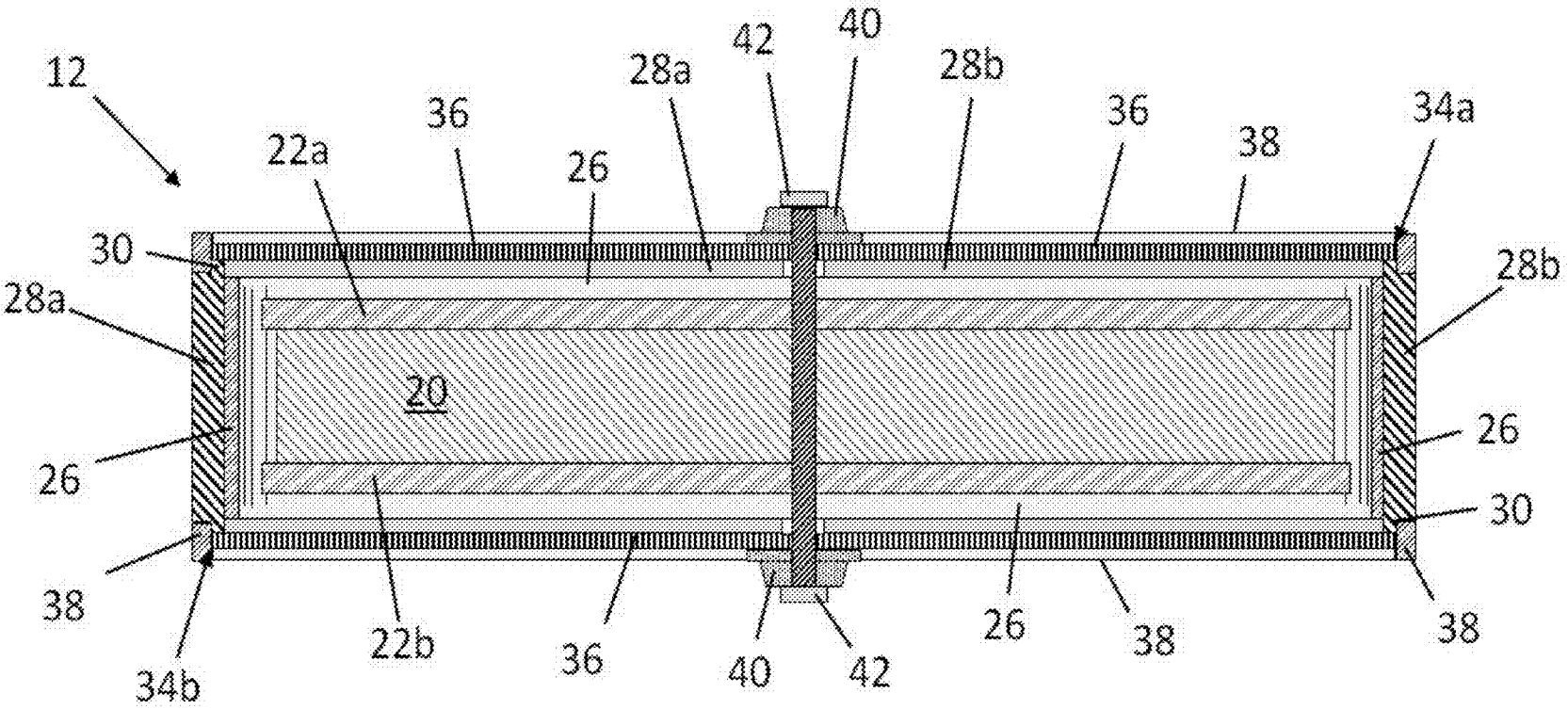
FIG. 4 shows a cross-sectional elevational view of the embodiment of FIG. 1.

Referring to FIGS. 3 and 4, greater details of the motor 12 may be explained. In one embodiment, the motor 12 comprises a magnet 20 sandwiched between a first cover plate 22*a* and second cover plate 22*b*, both of which have central holes 24 therethrough to correspond to a central hole within the magnet. The magnet 20 and cover plates 22 are sized to fit just within the interior diameter of a voice coil 26. Although the voice coil 26 is not the subject of the present invention per se, preferably the voice coil comprises one or more copper coils surrounded by a layer of Kapton® polymide film on the inside and a layer of fiberglass on the outside. Given the significant temperature swing under which the voice coil operates, this tri-layer composite configuration is effective. Besides copper, other electrically conductive materials may be used for the voice coil windings including, but not limited to, aluminum, copper-clad aluminum, and silver. When power is delivered to the voice coil, it functions essentially opposite of a conventional speaker. Instead of power delivered to the magnet driving reciprocal movement of the voice coil, in the case of a bass shaker, the power delivered to the voice coil drives reciprocal movement of the magnet. In the case of a speaker, the reciprocal movement of the voice coil causes a diaphragm to move in a reciprocating fashion to generate sound waves. In the case of a bass shaker, the reciprocal movement of the magnet causes vibrational forces on the system, which is then translated to whichever surface that bass shaker is connected, which vibrational forces can be both felt and heard. In that regard, the magnet, the magnet cover plates and the voice coil may be of any number of possible configurations and materials to carry out such functionality.

Still referring to FIGS. 3 and 4, the system also comprises a split motor case, which in on embodiment of the present invention comprises first and second motor case members 28*a*, 28*b* each having generally semi-cylindrical configurations and each further comprising radial ridges 30 along opposite sides. A traditional motor case comprises a singular cylinder to surround and enclose the voice coil in a protective and stabilizing manner. In the case of the present invention, the traditional motor case is split into two or more components to reduce eddy currents that form in the motor case during operation. By reducing eddy current, residual heat buildup is reduced, and an increase in operational efficiency may be experienced. The split configuration further aids in the assembly of the motor. When assembled, the magnet and cover plates reside within the voice coil, which then is enclosed snugly within the motor case members 28*a*, 28*b* preferably without the ends of the motor case members touching. The radial ridges 30 of the motor case members serve to receive spiders in close engagement, as explained below.

Embodiments of the present invention further comprise preferably first and second spiders 34*a*, 34*b*, which together sandwich the motor case members. Each spider 34*a*, 34*b* comprises a plurality of spider legs 36 securely enclosed within a collar 38. In a preferred embodiment, four number of spider legs 36 are provided, although lesser or greater numbers are contemplated. In some embodiments, the collar 38 comprises interior shoulders that are configured to mate with the ridges 30 of the motor case members for close and snug engagement. Such an arrangement not only creates a tighter fit, but helps align the motor case members. Preferably, the spider legs are made of a glass epoxy material to create a durable but somewhat flexible plate. Although the spider legs are secured at a radially outward end to the collar 38, they are connected at a radially inward end to each other, preferably leaving a central opening for mechanical fastening, as described below. By doing so, the radial interior of the spiders 34*a*, 34*b* may move axially in spring fashion with the reciprocating movement of the magnet 20 while the collar 38 remains in a fixed position engaged to the motor case members 28*a*, 28*b*. Making the spider legs 36 out of glass epoxy material or similar material, movement may occur with reduced incidents of breakage. Having a fourth leg adds further robustness to the spider, as tests have shown.

To tightly secure the motor components together, first and second caps 40 are employed, through which a mechanical fastener 40 may be inserted. Some embodiments of the present invention include caps 40 that comprise openings or vents therein to reduce air turbulence within the motor, and to provide a further release for heat radiating outwardly from within the motor. The caps 40 secure the spiders to the motor case members 28*a*, 28*b* and magnet 20 in a manner where the radial interior of the spider legs 36 moves with the magnet 20 while the spider collars 38 remain minimally motionless in engagement with the motor case members and the voice coil 26.

Persons of ordinary skill in the art may appreciate that numerous design configurations may be possible to enjoy the functional benefits of the inventive systems. For example, in some embodiments, the system cover may include vent holes to facilitate heat transfer from within the motor to the ambient. Thus, given the wide variety of configurations and arrangements of embodiments of the present invention, the scope of the invention is reflected by the breadth of the claims below rather than narrowed by the embodiments described above.

What is claimed is:

1. A tactile transducer system suitable for use as a bass shaker, the system comprising:

a motor comprising:

a magnet having a generally cylindrical configuration, the magnet comprising first and second generally planar surfaces at opposite ends;

first and second cover plates securable to the first and second magnet surfaces, respectively, when the motor is assembled so as to effectively sandwich the magnet between the cover plates;

a voice coil comprising a multi-layer composite of two protective layers sandwiching a plurality of conductive coils;

a motor case comprising first and second arcuate members, the first and second arcuate members configured to tightly envelop an exterior surface of the voice coil while still leaving a gap between adjacent ends of the first and second arcuate members, the multi-piece motor case functioning together in a manner that reduces eddy currents and heat generation as compared to a unitary motor case;

first and second spiders each comprising a spring portion and a ring portion, the spring portions each comprising at least four legs extending radially outward from a central hub, the spring portions comprising glass epoxy material and configured to fit snugly within the corresponding ring portion;

first and second ventilated mechanical caps, each configured to secure each cover plate to a corresponding magnet surface, the ventilated mechanical fasteners comprising a plurality of apertures permitting heat and air flow therethrough during operation of the system, each ring comprising an annular shoulder configured to permit snug engagement with corresponding ridges on the motor case members to assist in keeping the motor case members aligned and secured in annular fashion with the voice coil when assembled;

where the first and second spiders are configured to be mechanically fastened to the first and second ventilated mechanical fasteners, respectively to secure the motor and spiders together when the system is assembled, the motor and spider configured such that reciprocal axial movement of the magnet within the voice coil and motor case members causes the spring portions of each spider to move in concert with the magnet while the voice coil and motor case remain substantially still, and a housing comprising a base portion and a cover portion, the base portion comprising a generally annular seat to accommodate in secure attachment the motor when the system is assembled to stabilize the motor during operation, the cover portion comprising a plurality of ventilation holes to further release heat to the ambient during operation.

* * * * *